US007770314B2

(12) United States Patent
Dean

(10) Patent No.: US 7,770,314 B2
(45) Date of Patent: Aug. 10, 2010

(54) OUTDOOR ADVERTISING SYSTEM

(75) Inventor: Eric Dean, Temple Terrace, FL (US)

(73) Assignee: Irvin Steel, Inc., Tampa, FL (US)

( * ) Notice: Subject to any disclaimer, the term of this patent is extended or adjusted under 35 U.S.C. 154(b) by 0 days.

(21) Appl. No.: 11/509,189

(22) Filed: Aug. 24, 2006

(65) Prior Publication Data

US 2008/0047184 A1 Feb. 28, 2008

(51) Int. Cl.
*G09F 15/00* (2006.01)

(52) U.S. Cl. ..... 40/624; 248/219.1; 248/221.11; 248/489

(58) Field of Classification Search ..... 40/624, 40/606.18, 606.01, 603, 604, 612; 211/189; 248/220.21, 222.11, 219.1, 489, 490, 495, 248/218.4

See application file for complete search history.

(56) References Cited

U.S. PATENT DOCUMENTS 1,511,429 A * 10/1924 Schenker ..... 40/624
1,665,142 A * 4/1928 Merker ..... 40/624
1,675,357 A * 7/1928 Kollman et al. ..... 40/624
1,860,919 A * 5/1932 Ansel ..... 40/624
1,901,282 A * 3/1933 Burket ..... 40/624
2,194,367 A * 3/1940 Petzold ..... 40/624
2,557,387 A * 6/1951 Michael et al. ..... 40/624
2,615,178 A * 10/1952 Karg ..... 5/210
2,948,976 A * 8/1960 Miller, Jr. ..... 40/624
3,160,974 A * 12/1964 Carleton ..... 40/624
3,176,418 A * 4/1965 Ramseur, Jr. ..... 40/624
3,776,382 A * 12/1973 Wright et al. ..... 209/403
3,928,929 A * 12/1975 Forte ..... 40/607.12
4,317,302 A * 3/1982 Von De Linde ..... 40/549
4,547,987 A * 10/1985 Stilling ..... 40/574
4,922,988 A * 5/1990 Loomis ..... 160/368.1
6,594,932 B2 * 7/2003 Hurst et al. ..... 40/603
2005/0262743 A1 * 12/2005 Siegenthaler ..... 40/603

* cited by examiner

*Primary Examiner*—William L. Miller
(74) *Attorney, Agent, or Firm*—Arthur W. Fisher, III

(57) ABSTRACT

An outdoor advertising system to support and selectively display an inside panel assembly or an outside panel assembly comprising a substantially rectangular outer frame having a plurality of interior support members attached thereto, a plurality of stringer coupling assemblies to couple a plurality of stringer members to the plurality of interior support members and a plurality of adjustable attachment panel assemblies to attach the inside panel assembly and the outside panel assembly to the substantially rectangular outer frame.

4 Claims, 6 Drawing Sheets

OUTDOOR ADVERTISING SYSTEM

BACKGROUND OF THE INVENTION

1. Field of the Invention

An outdoor advertising system to support an inside flexible panel and an outside flexible panel.

2. Description of the Prior Art

Outdoor advertising billboard structures are generally found along a roadsides, roof tops and sides of buildings.

Older billboard structures commonly include a plurality of substantially planar panels mounted adjacent one another to form a large, flat area to accommodate the advertisement or message. The advertisement image can be painted directly on the panels of the billboard structure. Another method is to paste preprinted signs over the panels of the billboard structure.

Recently, flexible material signs or displays or the like are used on billboard or other structures capable of carrying a flexible sign. These signs are generally lightweight and relatively inexpensive to manufacture. A variety of methods are known for mounting these types of signs to billboard structures. One such method is to wrap the flexible material sign around a show surface of the billboard structure and tie opposing edges of the sign together using cord material or the like. Another method is to install elongated members or rods through hemmed edges formed in the sign and secure the elongated members to a billboard structure.

U.S. Pat. No. 2,615,178 shows an adjustable resilient support means and frame with a plurality of separate blocks formed from natural or synthetic rubber or rubber like materials. The frame is made from an element that is hollow and rectangular in shape. Bolts extend through bores in the blocks, one edge of each is positioned against the inner surface of the inner wall of the frame. The bolts transmit compressive forces to the block by nut and washer that are associated with the outer ends of the bolts and include nuts and washers. Adjustment of the nuts on the bolts tension is set in the sheet and can be varied to achieve desired tension. Connection between the sheet and the frame form a desired resilience or flexibility to the sheet allowing comfortable load support.

U.S. Pat. No. 3,776,382 discloses a circular screen frame assembly comprised of a screen, a support ring and an annular clamping and tensioning assembly. The annular clamping and tensioning assembly comprise a clamping and a tensioning ring. The support ring is positioned and held within the housing of the assembly. The clamping ring circumferentially secures the screen to the tensioning ring with the resulting annular clamping and tensioning assembly positioned about the support ring with adjustable fixing means. Tensioning of the circular screen is effected by horizontal or vertical displacement of the annular clamping and assembly with reference to the support ring about a plurality of points about the rings.

U.S. Pat. No. 4,317,302 relates to a display sign cabinet having a main frame and a support frame formed by an extended box beam. The support frame is disposed along the periphery of the main frame with sufficient structural strength to substantially reduce the need for support braces and carrying a plurality of individual slidable clamping assemblies in a raceway at one side of the beam to secure and maintain a sign face under tension sufficient to withstand wind forces on the sign face.

U.S. Pat. No. 4,547,987 discloses an intermediate frame for a sign box having a first hinging member around its perimeter and having an outer face frame for supporting a face panel. The intermediate frame a generally rectangular construction with two ends, and a top and a bottom joining at corners, each of them having an outer wall, a face panel support connected with the outer wall and extending inwardly for supporting a face panel. A series of face frames for supporting a panel of flexible sign material and panel tensioning members for use therewith. are also included.

U.S. Pat. No. 4,922,988 teaches a tension mounting system and assembly for suspending a flexible sheet material in a taut condition from a generally planar support surface and providing selective tension adjustment of the flexible sheet material is provided for use in signs displaying advertising material such as billboards, signboards and the like.

U.S. Pat. No. 6,594,932 shows sign mounting system to mount and tension a display sign. The display sign has a substantially planar surface to which support members are mounted to form a perimeter frame. Bracket assemblies are attached to the support members. The bracket assemblies retain the substrate and allow tensioning of the substrate to create a taut display. A bracket assembly may have rotatable members to facilitate installation of the substrate.

U.S. 2005/0262743 relates to a system and method for mounting a flexible material sign to a billboard structure includes a plurality of tensioning clamps affixed to the billboard structure. Each of the plurality of clamps includes a bracket adapted to be secured to the billboard structure and an adjustable J-bolt moveably secured to the bracket. The J-bolt includes a hooked section for passing through and hanging the flexible material sign to the billboard structure. To taughtly mount the flexible material sign to the billboard structure, the brackets are secured to the billboard structure with fasteners. The hooked sections of the J-bolts are passed through the sign to hang the sign from the billboard structure. The J-bolts are adjusted relative to the bracket to hang the sign a preselected distance from the billboard structure and to apply a tension to the sign to maintain a desired taughtness of the sign.

SUMMARY OF THE INVENTION

The present invention relates to an outdoor advertising system for use with an outdoor advertising display elevated above the ground.

The outdoor advertising system comprises an outer frame having a plurality of elongated interior support members attached thereto and a plurality of stringer coupling assemblies to couple a plurality of string members to the plurality of elongated interior support members. A plurality of adjustable panel attachment assemblies attach an inside panel assembly comprising a flexible panel and an elongated upper panel attachment bar or rod and an elongated lower panel attachment bar or rod and a similarly constructed outside panel assembly to the outer frame.

The outer frame comprises an elongated upper frame member and an elongated lower frame member held in substantially arallel relationship relative to each other by an elongated side frame member attached to corresponding end portions of the elongated upper frame member and the elongated lower frame member by a corresponding frame attachment or connector assembly.

Opposite end portions of each elongated interior support member are attached to the elongated upper frame member and the elongated lower frame member a corresponding interior support attachment or connector assembly.

A notch or gap is cooperatively formed between the elongated upper frame member and the elongated lower frame member and the corresponding upper and lower end portions of the elongated interior support members.

Each stringer coupling assembly comprises an upper stringer clamp and a lower stringer support. The upper stringer clamp comprises a bracket and a resilient stringer clip to engage the outer surface of the corresponding stringer member. The lower stringer support comprises a bracket to engage and support the corresponding stringer member thereon.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
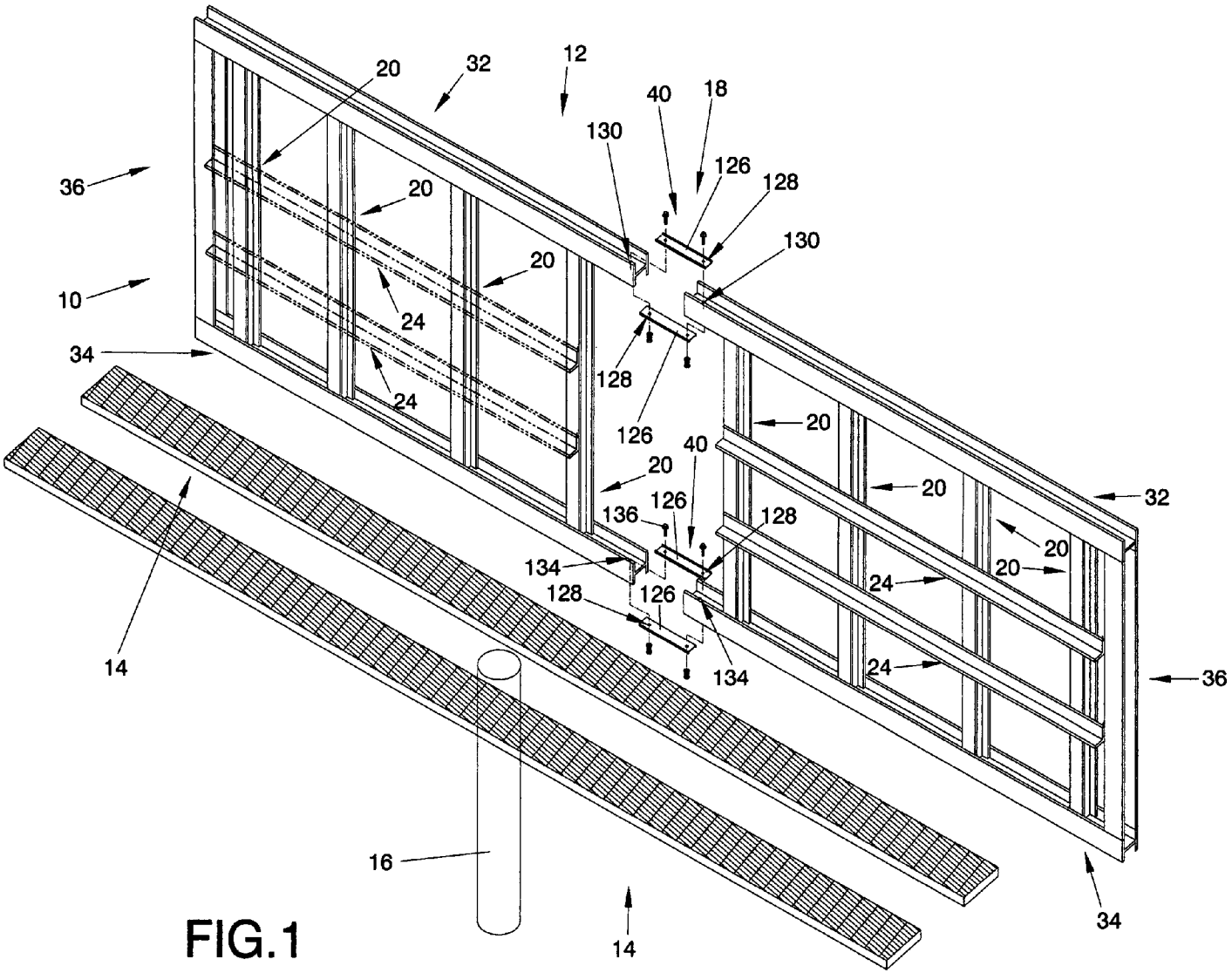
FIG. 1 is an exploded prospective view of an outdoor advertising display including the outdoor advertising system of the present invention.

FIG. 1 depicts an outdoor advertising display generally indicated as 10 comprising the outdoor advertising system of the present invention generally indicated as 12 and at least one catwalk generally indicated as 14 elevated above the ground by at least one upright support member 16.

Figure 2:
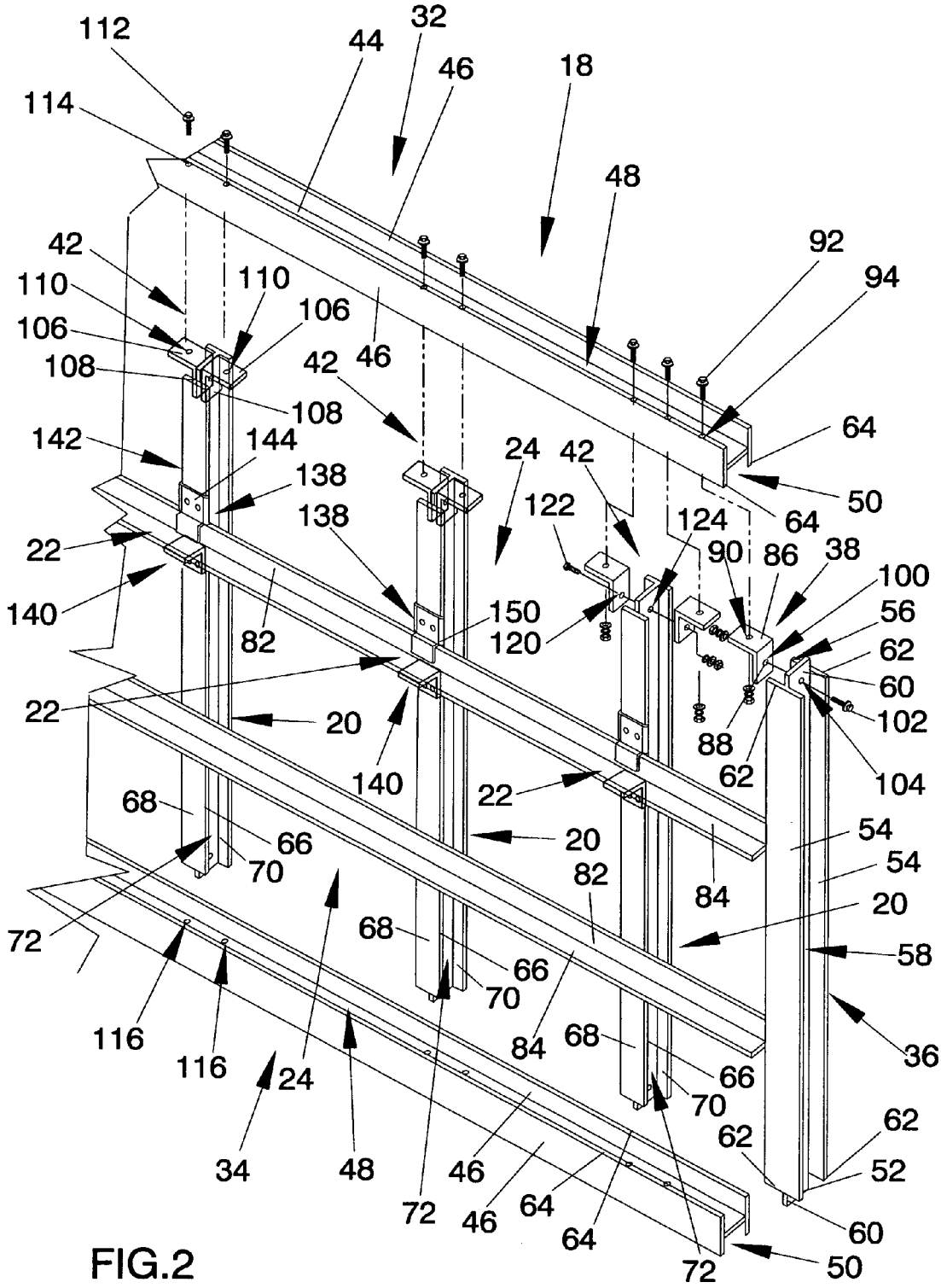
FIG. 2 is an exploded partial perspective view of the outdoor advertising system of the present invention.
Figure 9:
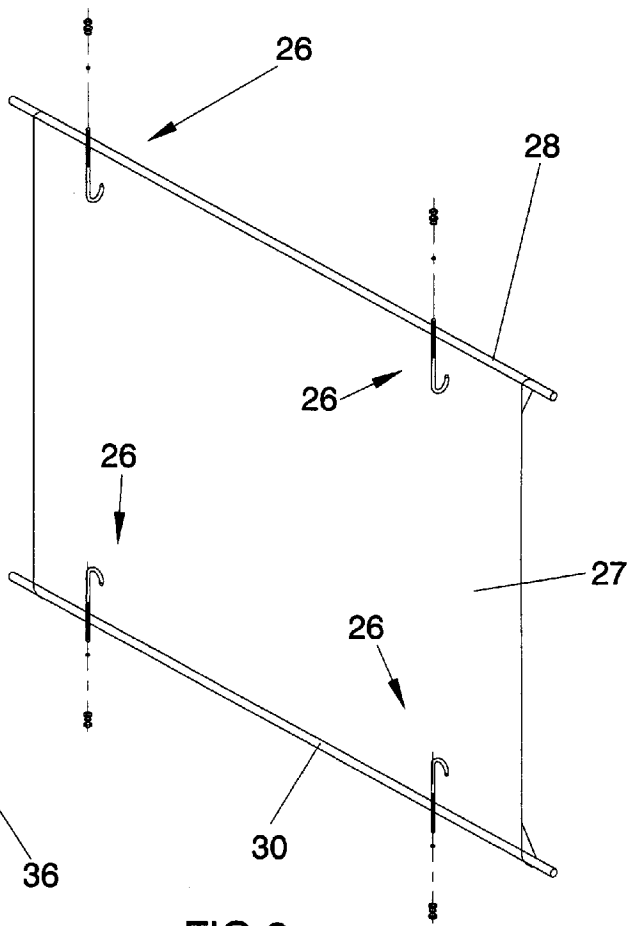
FIG. 9 is a schematic of the adjustable panel attachment assembly.
Figure 8:
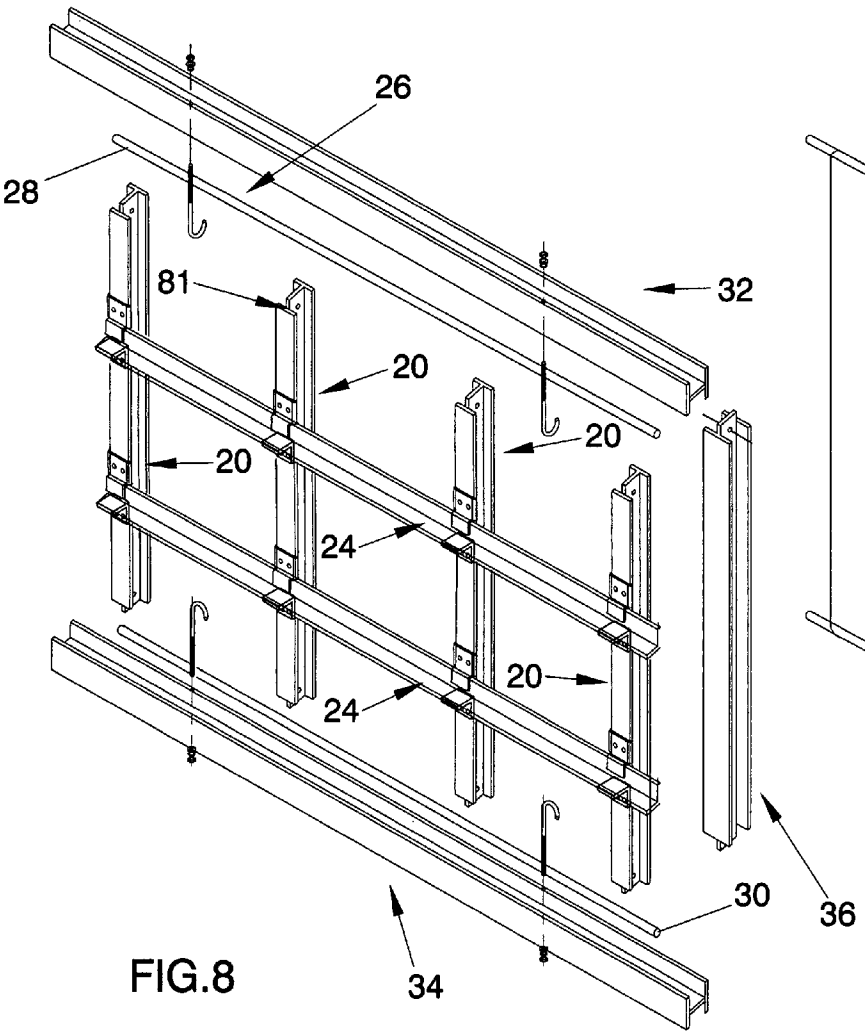
FIG. 8 is an exploded perspective view of the outdoor advertising system of the present invention detailing the adjustable panel attachment assembly.

As best shown in FIG. 2, the outdoor advertising system 12 comprises a substantially rectangular outer frame generally indicated as 18 having a plurality of elongated interior support members each generally indicated as 20 attached thereto and a plurality of stringer coupling assemblies each generally indicated as 22 to couple a plurality of stringer members each generally indicated as 24 to the plurality of elongated interior support members 20. A plurality of adjustable panel attachment assemblies each indicated as 26 are provided to attach an inside panel assembly comprising a flexible panel 27 (FIG. 9) and an elongated upper panel attachment bar or rod 28 and an elongated lower panel attachment bar or rod 30 (FIG. 5), and a similarly structured (not shown) outside panel assembly to the substantially rectangular outer frame 18.

Figure 5:
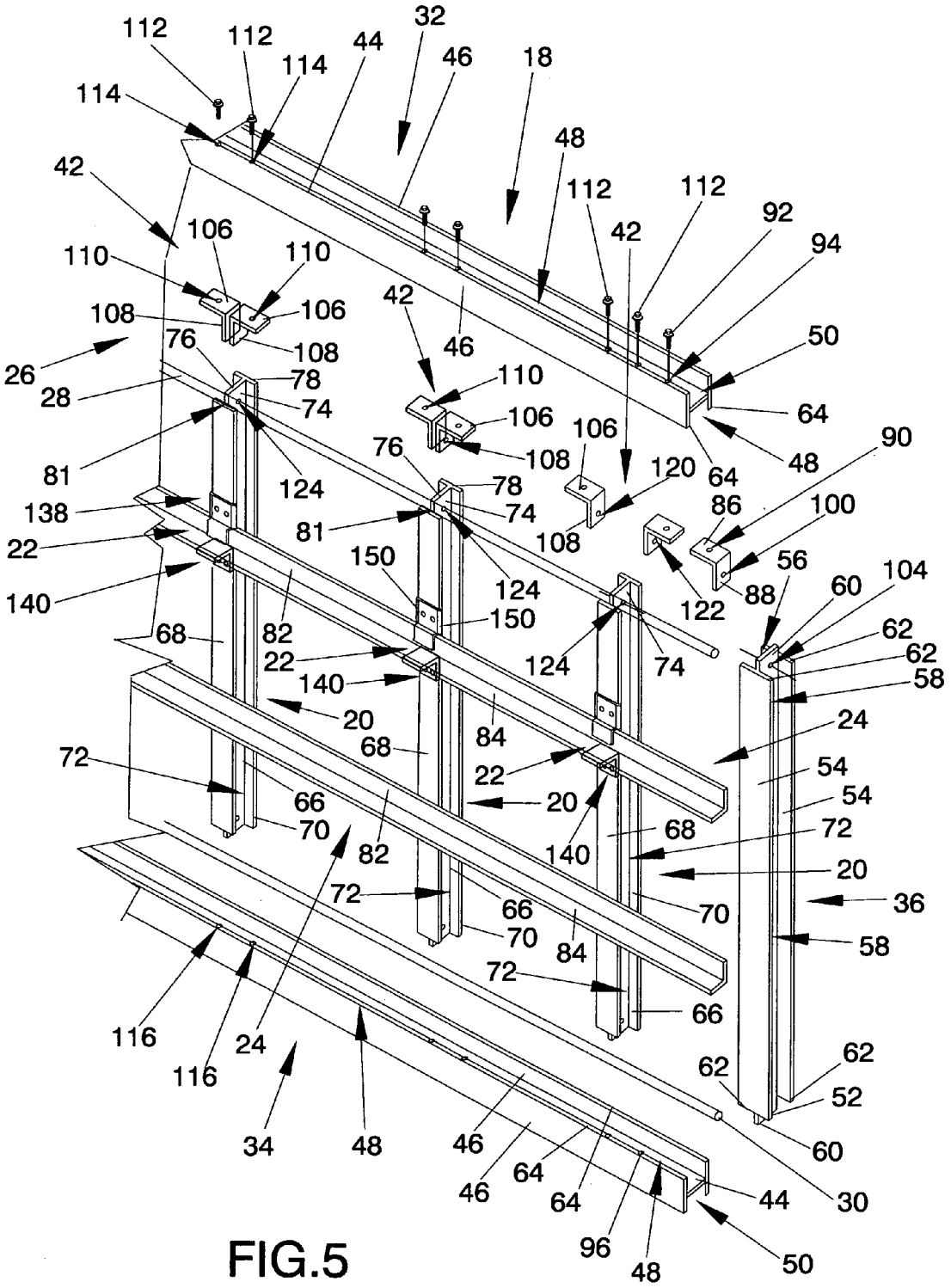
FIG. 5 is an exploded partial perspective view of the outdoor advertising system of the present invention.

As shown in FIGS. 1, 2 and 5, the substantially rectangular outer frame 18 comprises an elongated upper frame member and an elongated lower frame member generally indicated as 32 and 34 respectively held in substantially parallel relationship relative to each other by an elongated side frame member generally indicated as 36 attached to corresponding end portions of the elongated upper frame member 32 and the elongated lower frame member 34 by a corresponding frame attachment or connector assembly generally indicated as 38. The substantially rectangular outer frame 18 shown in FIG. 1 comprises a pair of elongated upper frame members 32 and a pair of elongated lower frame members 34 wherein each corresponding pair of elongated frame members 32 and 34 is spliced or connected together by a corresponding splice assembly generally indicated as 40.

As shown in FIGS. 2 and 5, opposite end portions of each elongated interior support member 20 are attached to the elongated upper frame member 32 and the elongated lower frame member 34 by a corresponding interior support attachment or connector assembly generally indicated as 42.

Figures 4, 4A, 4B:
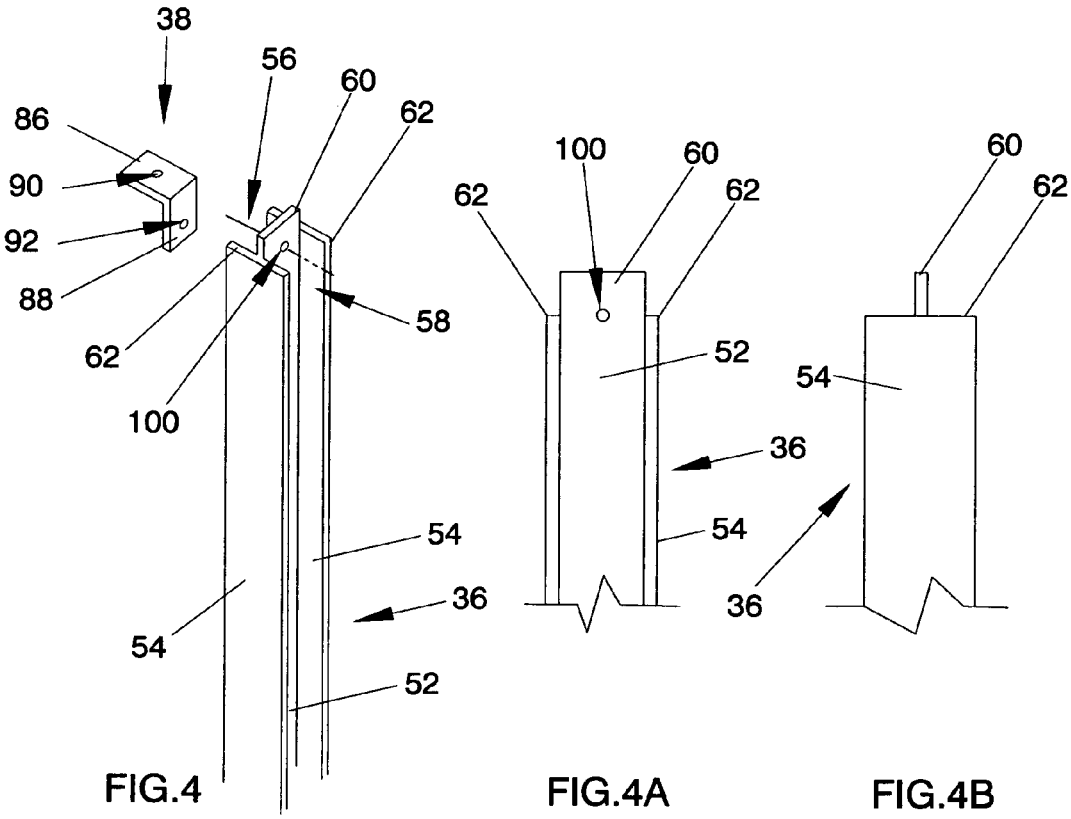
FIGS. 4, 4A and 4B are views of an elongated side frame member of the outdoor advertising system of the present invention.

As best shown in FIGS. 2 and 5, the elongated upper frame member 32 and the elongated lower frame member 34 each has a substantially H- or I-shape or configuration comprising an inner connecting web or element 44 having an outer flange or element 46 affixed to opposite end portions thereof to cooperatively form an inner frame channel 48 and an outer frame channel 50. As best shown in FIGS. 2, 4 and 5, each elongated side frame member 36 comprises an inner connecting web or element 52 having an outer flange or element 54 affixed to opposite end portions thereof to cooperatively form an inner frame channel 56 and an outer frame channel 58. The longitudinal dimension of the inner connecting web or element 52 is greater than the longitudinal dimension of each outer flange or element 54 such that the opposite outer end portions of the inner connecting web or element 52 extend beyond opposite ends of the outer flange or element 54 to form a corresponding projection or tab 60 extending into the inner frame channel 48 of the elongated upper frame member 32 and the elongated lower frame member 34 whereby the corresponding outer edge or end surface 62 of each outer flange or element 54 of the corresponding elongated side frame member 36 engages the corresponding outer edge or end surface 64 of the corresponding outer flange or element 46 of the elongated upper frame member 32 and the elongated lower frame member 34. In addition, the outer edge or end surface of each projection or tab 60 may engage the inner surface of the inner connecting web or element 44 of the corresponding inner frame channel 48.

Figures 3, 3A, 3B:
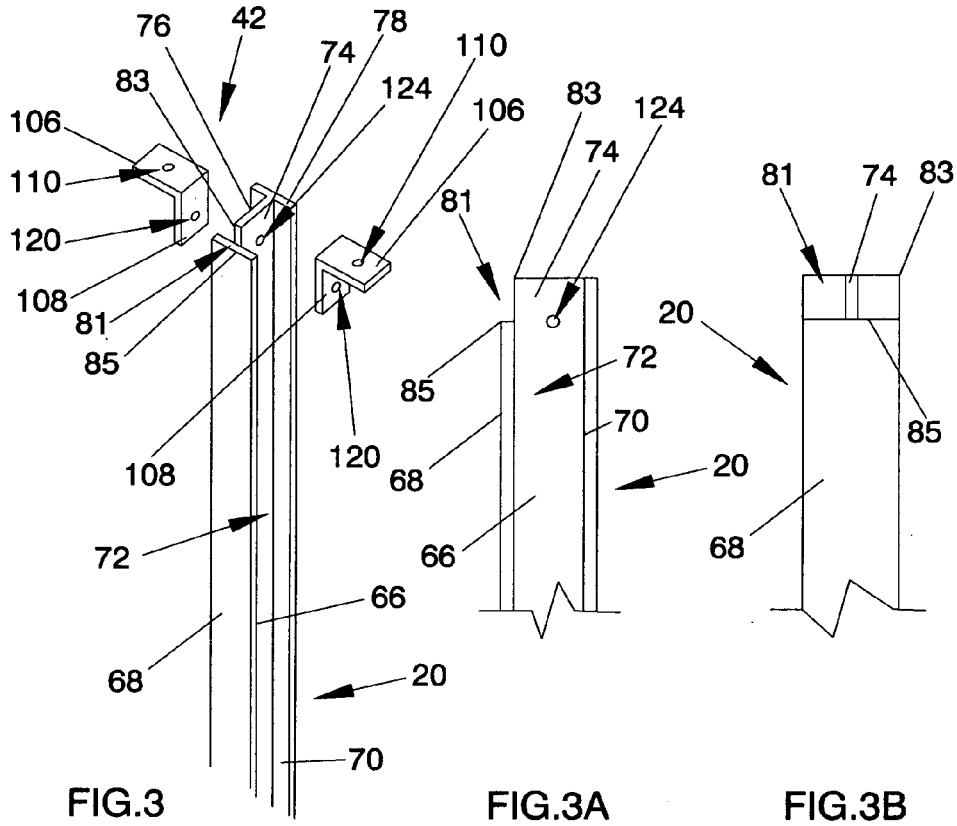
FIGS. 3, 3A and 3B are partial views of an elongated interior support member of the outdoor advertising system of the present invention.

As best shown in FIGS. 2, 3 and 5, each elongated interior support member 20 has a substantially H- or I-shape or configuration comprising an inner connecting web or element 66 having a first outer flange or element and a second outer flange or element indicated as 68 and 70 respectively affixed to opposite end portions thereof to cooperatively form a pair of interior channels each indicated as 72. The width of each elongated interior support member 20 is less than the width of inner frame channel 48 of the elongated upper frame member 32 and the elongated fower frame member 34 such that opposite end portions of each elongated interior support member 20 are disposed therein. The longitudinal dimension of the inner connecting web or element 66 is greater than the longitudinal dimension of the first outer flange or element 68 such that the opposite outer end portions of the inner connecting web or element 66 extend beyond opposite outer end portions of each first flange or element 68 to form a corresponding projection or tab 74 extending into the inner frame channel 48 of the elongated upper frame member 32 and the elongated lower frame member 34 whereby the corresponding edge or end surface 76 of the inner connecting web or element 66 and the end surface 78 of each second outer flange or element 70 of the corresponding elongated interior frame member 20 engages the corresponding interior surface 80 of the corresponding inner connecting web or element 44 of the elongated upper frame member 32 and the elongated lower frame member 34.

As best shown in FIG. 3, a notch or gap 81 is cooperatively formed by the outer end 83 of each projection or tab 74 and the corresponding end portion 85 of the first outer flange or element 68 to receive a portion of the elongated upper panel attachment bar or rod 28 and elongated lower panel attachment bar or rod 30 (FIG. 5).

Figure 6:
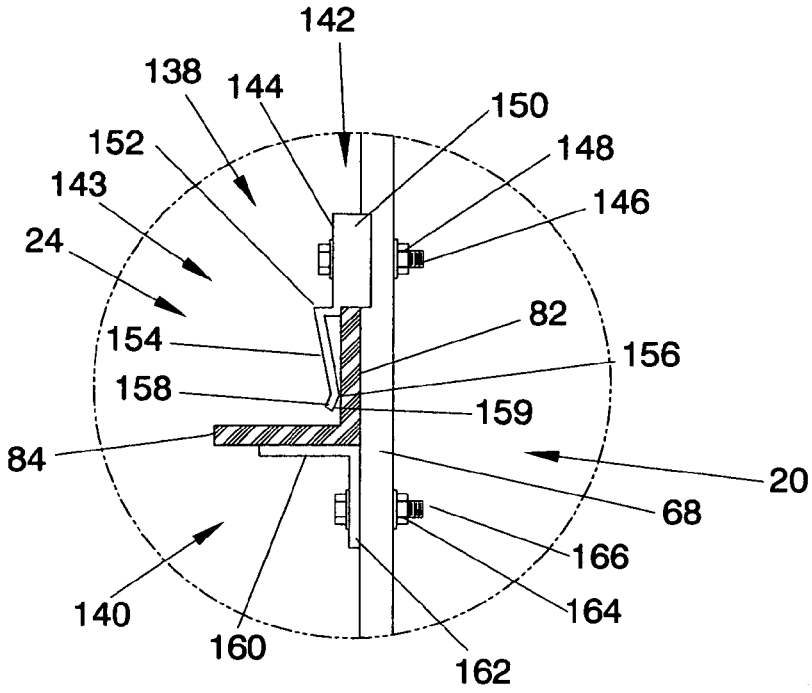
FIG. 6 is a side view of a stringer coupling assembly of the outdoor advertising system of the present invention.

As best shown in FIGS. 2, 5 and 6, each stringer member 24 comprises an L-shaped bracket including a first leg or flange and a second leg or flange indicated as 82 and 84 respectively disposed at a substantially right angle relationship relative to each other.

As best shown in FIGS. 2, 4 and 5, each frame attachment or connector assembly 38 comprises a substantially L-shaped bracket including a first leg or flange and a second leg or flange indicated as 86 and 88 respectively disposed at a substantially right angle relationship relative to each other. Each leg or flange 86 includes an aperture 90 to receive a fastening member 92 therethrough that extends either through a corresponding aperture 94 formed in the inner connecting web or element 44 of the elongated upper frame member 32 or through a corresponding aperture 96 formed in the inner connecting web or element 44 of the elongated lower frame member 34. Each leg or flange 88 includes an aperture 100 to receive a fastening member 102 therethrough that extends through a corresponding aperture 104 formed through each end portion of the inner connecting web or element 52 of each elongated side frame member 36.

As best shown in FIGS. 2, 3 and 5, each interior support attachment or connector assembly 42 comprises a pair of substantially L-shaped brackets each including a first leg or flange and a second leg or flange indicated as 106 and 108 respectively disposed at a substantially right angle relationship relative to each other. Each first leg or flange 106 includes an aperture 110 to receive a fastening member 112 therethrough that extends either through a corresponding aperture 114 formed in the inner connecting web or element 44 of the elongated upper frame member 32 or through a corresponding aperture 116 formed in the inner connecting web or element 44 of the elongated lower frame member 34. Each second leg or flange 108 includes an aperture 120 to receive a fastening member 122 therethrough that extends through a corresponding aperture 124 formed through each end portion of the inner connecting web or element 66 of each elongated interior support member 20.

Figure 7:
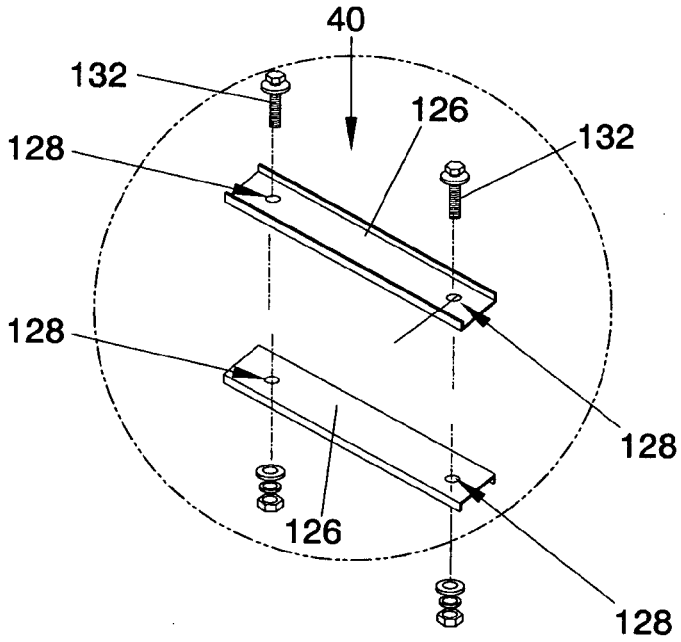
FIG. 7 is an exploded perspective view of a splice assembly of the outdoor advertising system of the present invention.

As shown in FIGS. 1 and 7, each splice assembly 40 comprises a substantially U-shaped member 126 including an aperture 128 formed through opposite end portions thereof disposed on opposite sides of adjacent elongated upper frame members 32 each including an aperture 130 formed therethrough to receive a fastening member 132 therethrough to secure a substantially U-shaped member 126 to opposite sides of the inner connecting web or element 44 of adjacent elongated upper frame member 32 disposed on opposite sides of adjacent elongated lower frame members 34 each including an aperture 134 formed therethrough to receive a fastening member 136 therethrough to secure a substantially U-shaped member 126 to opposite sides of the inner connecting web or element 44 of adjacent elongated lower frame member 34.

As shown in FIGS. 2, 5 and 6, each stringer coupling assembly 22 comprises an upper stringer clamp and a lower stringer support generally indicated as 138 and 140 respectively.

As best shown in FIG. 6, the upper stringer clamp 138 comprises a substantially U-shaped bracket and a resilient stringer clip generally indicated as 142 and 143 respectively. The substantially U-shaped bracket 142 comprises a stringer plate 144 secured or attached to the face of the first outer flange or element 68 of the corresponding elongated interior support member 20 by at least one fastening device such as a bolt 146 and nut 148 combination disposed to engage the top of the first leg or flange 82 of the corresponding stringer member 24 having a stop member 150 formed on each side thereof to engage opposite sides of the first outer flange or element 68 to prevent rotation of the stringer coupling assembly 22 when secured to the corresponding elongated interior support member 20.

The resilient stringer clip 143 comprises an offset spacer element 152 extending outwardly from the lower portion of the stringer plate 144 having a bias member 154 depending downwardly therefrom angled inwardly toward the first outer flange element 68 of the corresponding elongated interior support member 20 to create an inward bias against the first leg or flange 82 of the corresponding stringer 24 terminating in a clamping surface 156 and to clamp the first leg or flange 82 against the corresponding stringer member 24 and a reverse angle member 158 forming a cam surface 159 to engage the outer surface of the first leg or flange 82 of the corresponding stringer member 24 during assembly of the outdoor advertising system 12.

As best shown in FIG. 6, the lower stringer support 140 comprises a substantially L-shaped bracket including a first leg or flange and a second leg or flange indicated as 160 and 162 respectively disposed at a substantially right angle relationship to each other. The lower stringer support 140 is secured or attached to the face of the first outer flange or element 68 of the corresponding elongated interior support member 20 by at least one fastening device such as a bolt 164 and nut 166 combination below the corresponding stringer member 24 such that the first leg or flange 160 engages and supports the second leg or flange 84 of the corresponding stringer member 24 thereon.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An outdoor advertising system to support and selectively display an inside panel assembly or an outside panel assembly comprising an outer frame having a plurality of elongated interior support members attached thereto, a plurality of stringer coupling assemblies to couple a plurality of stringer members to the plurality of interior support members and a plurality of attachment panel assemblies to attach the inside panel assembly and the outside panel assembly to said outer frame wherein each said stringer coupling assembly comprises an upper stringer clamp and a lower stringer support, said upper stringer clamp comprises a bracket and a resilient stringer clip, said bracket comprises a stringer plate attached to each corresponding elongated interior support member disposed to engage the top portion of each corresponding stringer member and said resilient stringer clip comprises an offset spacer element extending outwardly from the lower portion of said stringer plate having a bias member depending downwardly therefrom angled inwardly to create an inward bias against said corresponding stringer member terminating in a clamping surface to clamp each corresponding stringer member to each said interior support member.

2. The outdoor advertising system of claim 1 wherein said resilient stringer clip includes a reverse angle member forming a cam surface to engage each said corresponding stringer member during assembly of said outdoor advertising system.

3. The outdoor advertising system of claim 2 wherein said lower stringer support comprises a substantially L-shaped bracket including a first leg or flange and a second leg or flange, said the lower stringer support being attached to the corresponding elongated interior support member by at least one fastening device below the corresponding stringer member.

4. The outdoor advertising system of, claim 1 wherein each said bracket further includes a stop member formed on each side thereof to prevent rotation of a corresponding stringer coupling assembly when secured to a corresponding elongated interior support member.

* * * * *